US009085078B1

(12) United States Patent
Huang

(10) Patent No.: US 9,085,078 B1
(45) Date of Patent: Jul. 21, 2015

(54) ROTATABLE AND EXTENDABLE MOP

(71) Applicant: Yi-Ping Huang, Taoyuan (TW)

(72) Inventor: Yi-Ping Huang, Taoyuan (TW)

( * ) Notice: Subject to any disclaimer, the term of this patent is extended or adjusted under 35 U.S.C. 154(b) by 0 days.

(21) Appl. No.: 14/672,702

(22) Filed: Mar. 30, 2015

(51) Int. Cl.

| | |
|---|---|
| ***A47L 13/142*** | (2006.01) |
| ***A47L 13/58*** | (2006.01) |
| ***B25G 1/04*** | (2006.01) |
| ***A47L 13/20*** | (2006.01) |

(52) U.S. Cl.
CPC ..... *B25G 1/04* (2013.01); *A47L 13/142* (2013.01); *A47L 13/20* (2013.01); *A47L 13/58* (2013.01)

(58) Field of Classification Search
CPC ..... A47L 13/142; A47L 13/58
See application file for complete search history.

(56) References Cited

U.S. PATENT DOCUMENTS

| | | | | |
|---|---|---|---|---|
| 8,316,502 | B2 * | 11/2012 | Shao | 15/119.1 |
| 8,978,193 | B2 * | 3/2015 | Chen | 15/260 |
| 9,021,648 | B1 * | 5/2015 | Chu | 15/119.1 |

* cited by examiner

*Primary Examiner* — Randall Chin
(74) *Attorney, Agent, or Firm* — Jackson IPG PLLC; Demian K. Jackson

(57) ABSTRACT

A rotatable and extendable mop includes a first rod body, a second rod body and a mop head. An end of the second rod body is sheathed with the first rod body, extending and moving relatively with respect to the first rod body. An end of the mop head is connected to the other end of the second rod body including a first connector, a second connector, a retainer, a gasket, a spring and a link rod. The first connector is sheathed with the second connector, and includes a first clip part corresponding to a first helical track, allowing the first clip part to traverse in the first helical track. An end of the link rod is connected to the second connector, and the retainer, gasket and spring are sheathed orderly with the link rod relative to the second connector. The retainer is fastened to the first connector.

12 Claims, 9 Drawing Sheets

ROTATABLE AND EXTENDABLE MOP

BACKGROUND OF THE INVENTION (a) Field of the Invention

The present invention relates to a mop, and more particularly to a rotatable and extendable mop which is provided with rod bodies of a better fixity and a spring made of sections in different modulus of elasticity to be compressed elastically and sectionally, thereby having a longer lifetime of usage.

(b) Description of the Prior Art

There are about two kinds of wet mops currently, and the mop head can be divided into a sponge mop head and a brush mop head. The sponge mop head is attached with a dehydration device to squeeze the sponge so that the dehydration can be very convenient. However, as the sponge can be expanded limitedly, blind spots can be dealt with more difficulty when cleaning a floor. On the other hand, for the brush mop head, cloth strips, cotton strips or any soft and long material that can absorb water can be used as the brushes. The advantage is that the brushes can be deformed and expanded that the blind spots can be cleaned up easily. Nevertheless, dehydrating the brush mop head is more troublesome.

For the conventional brush mop head, water on the brushes should be squeezed dry manually before the brushes are attached with clean water again to facilitate cleaning the floor, which results in a rather demanding work to mop the floor. Therefore, there is a vendor who develops a dehydration device for the mop, wherein a gear is driven by a pedal to rotate a bucket rapidly, which spins dry water on the mop hairs in the bucket. That device is able to improve the trouble of squeezing dry the mop hairs by hands. However, this kind of squeeze-dry method is very inefficient in that there is still a lot of water on the mop hairs after squeezing the mop hairs, and a user can only use one foot to keep balanced as he or she needs to use another foot to step the pedal continuously. Hence, the operation is more troublesome and the user may fall easily as he or she cannot stand steadily. On the other hand, all water in the bucket can be often spilled out as the user does not step evenly or steps too hard. Therefore, this prior art is not very practical.

A hand-press rotatable mop on the existing market is able to improve the problems of the aforementioned device. In addition, the rotatable mop also fits with a rotatable dehydration device. When the mop is put in the rotatable dehydration device, the user can squeeze the mop downward manually, and water on the mop hairs is squeezed dry by the simultaneous rotation of parts of the mop and the rotatable dehydration device. However, after the hand-press rotatable mop has been used for a while, parts in the rod body can get loose easily as the mop has been dehydrated by rotation for a long time, and the spring can be damaged by the accelerated elastic fatigue, thereby reducing the lifetime of usage of the mop.

SUMMARY OF THE INVENTION

Accordingly, the primary object of the present invention is to provide a rotatable and extendable mop which is provided with rod bodies of a better fixity and a spring made of sections in different modulus of elasticity to be compressed elastically and sectionally, thereby having a longer lifetime of usage.

To achieve the abovementioned object, the present invention discloses a rotatable and extendable mop which includes a first rod body, a second rod body and a mop head. An end of the first rod body is formed with a first shaft hole, and a wall of the first shaft hole is provided with at least one first helical track. An end of the second rod body is sheathed with the first rod body and extends and moves relatively with respect to the first rod body, and the second rod body includes a first connector, a second connector, a retainer, a gasket, a spring and a link rod. The first connector is sheathed with the second connector, allowing a first mono-directional spin axis connection piece of the first connector to be abutted with a second mono-directional spin axis connection piece of the second connector. The first connector is provided with a first clip part corresponding to the first helical track, allowing the first clip part to traverse in the first helical track. An end of the link rod is connected to the second connector, and the retainer, gasket and spring are sheathed orderly with the link rod from near to far relative to the second connector. The retainer is fastened to a retaining hole of the first connector. An end of the mop head is connected to the other end of the second rod body, whereas the other end of the mop head is provided with plural yarns.

To achieve the abovementioned object, the present invention discloses another rotatable and extendable mop which includes a first rod body, a second rod body and a mop head. An end of the first rod body is formed with a first shaft hole, and a wall of the first shaft hole is provided with at least one first helical track. An end of the second rod body is sheathed with the first rod body and extends and moves relatively with respect to the first rod body, and the second rod body includes a first connector, a second connector, a retainer, a gasket, a spring, a link rod and an adapter. The first connector is provided with a first clip part corresponding to the first helical track, allowing the first clip part to traverse in the first helical track. The second connector is sheathed with the first connector. The first connector is provided with a second shaft hole, and a wall of the second shaft hole is provided with at least one second helical track. The second connector is provided with a second clip part corresponding to the second helical track, allowing the second clip part to traverse in the second helical track, and a first mono-directional spin axis connection piece of the first connector to be abutted with a second mono-directional spin axis connection piece of the second connector. Two ends of the link rod in a shape of polygonal cylinder are connected to a connecting hole of the second connector and the adapter, respectively. The retainer, gasket and spring are sheathed orderly with the link rod from near to far relative to the second connector, and the retainer is fastened to a retaining hole of the first connector. The spring includes plural elastic sections in different coil spacing. A buffering bump is disposed on the link rod corresponding to a position between the elastic sections, allowing the plural elastic sections of the spring to be compressed from top to bottom sectionally. The mop head is disposed at the other end of the second rod body and an end of the mop head is connected to the adapter; whereas, the other end of the mop head is provided with plural yarns.

Accordingly, the rotatable and extendable mop of the present invention is provided with following features:

1. The rotatable and extendable mop is provided with the retainer to engage with the retaining hole of the first connector, which is able to increase the fixity of connection between the first connector and the second connector.
2. The second connector of the rotatable and extendable mop can be further provided with a clip part to connect with the helical track of the first connector, which stabilizes the connection and rotation between the first connector and the second connector.
3. The link rod of the rotatable and extendable mop is designed as a polygonal cylinder that is different from the circular connecting holes of the second connector and the adapter, thereby being able to decrease the probability of loosening to the combination of the link rod with the second connector and the adapter.

4. For the rotatable and extendable mop, the spring that is provided with the sections in different modulus of elasticity is sheathed on the link rod, which is able to extend the lifetime of usage and allow the user to have a better and progressive touch when using the mop.
5. For the rotatable and extendable mop, the buffering bumps are further disposed on the link rod corresponding to the position between the elastic sections, allowing the elastic sections to be compressed sectionally from top to bottom. Therefore, the compression force can be reduced sectionally, which extends the lifetime of usage of the mop.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
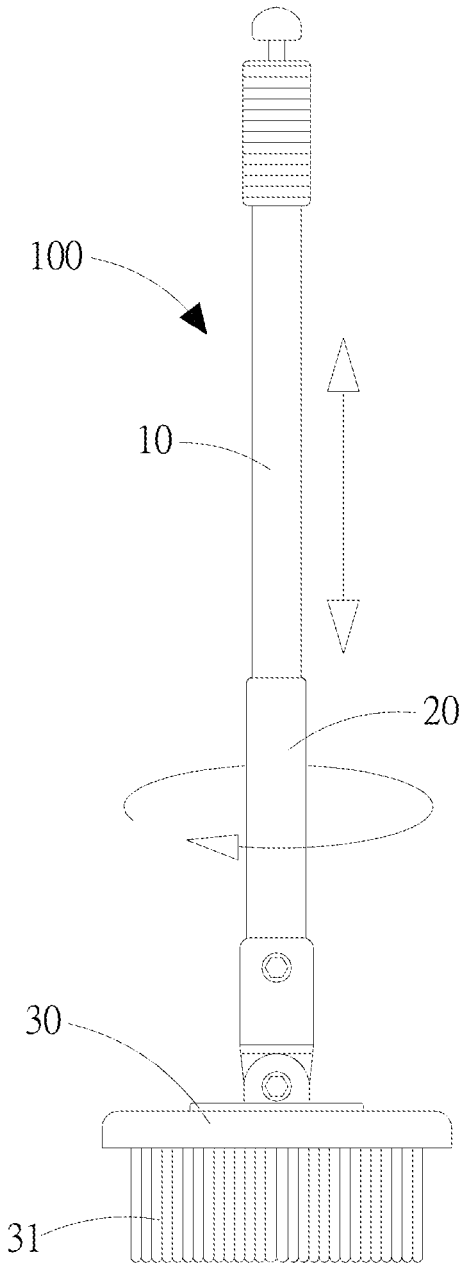
FIG. 1 shows a first schematic view of a first embodiment of rotatable and extendable mop, according to the present invention.
Figure 2:
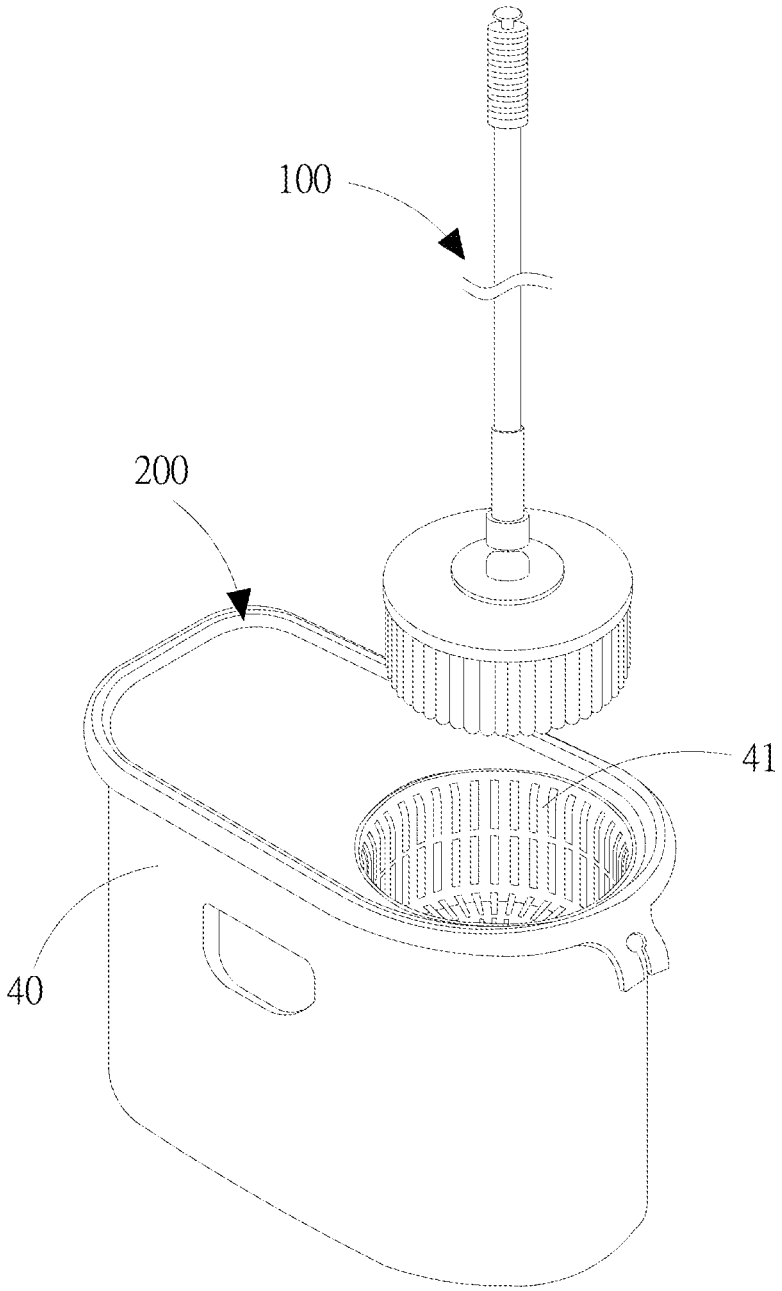
FIG. 2 shows a second schematic view of the first embodiment of rotatable and extendable mop, according to the present invention.
Figure 3:
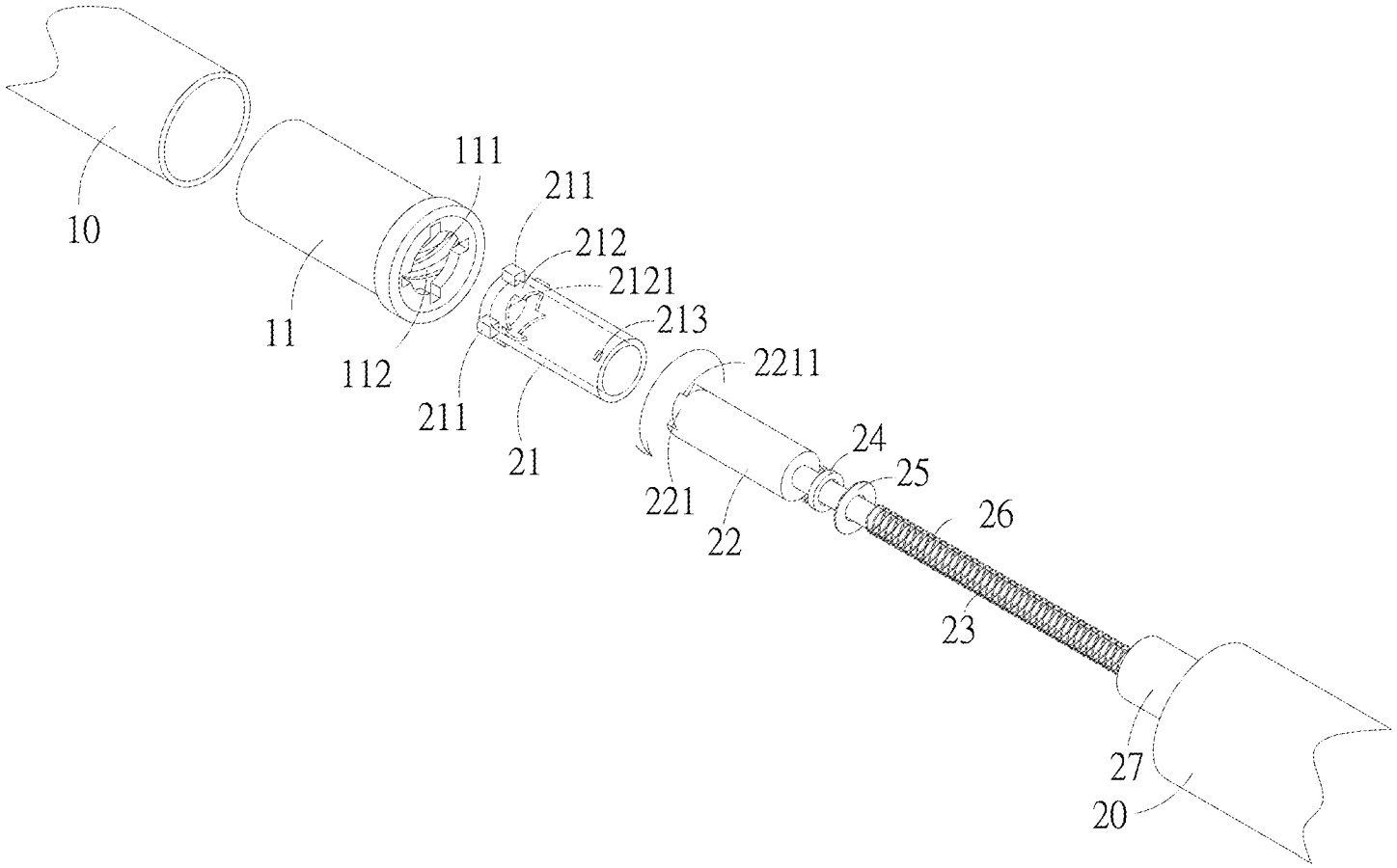
FIG. 3 shows a third schematic view of the first embodiment of rotatable and extendable mop, according to the present invention.
Figure 4:
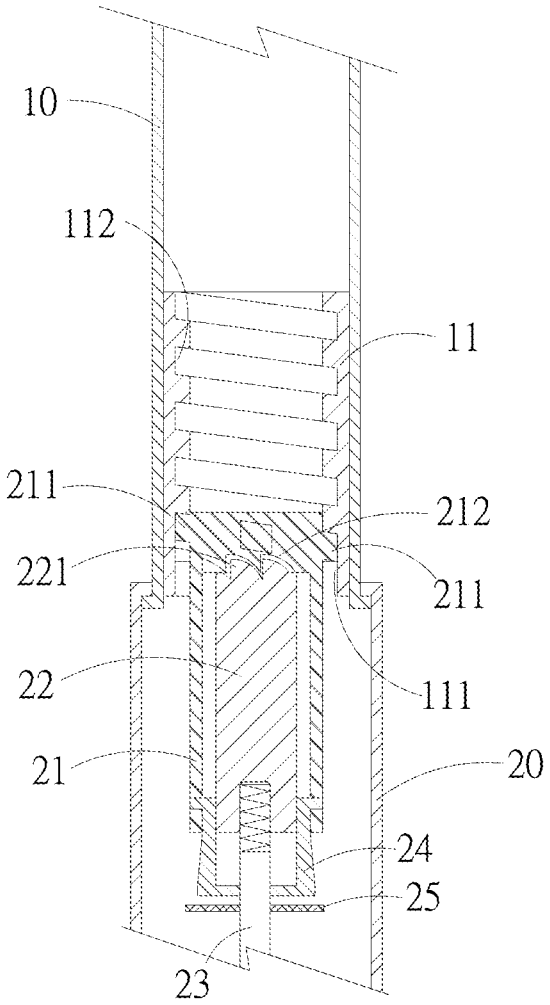
FIG. 4 shows a fourth schematic view of the first embodiment of rotatable and extendable mop, according to the present invention.

Referring to FIG. 1 and FIG. 2, it shows a first schematic view and a second schematic view of a first embodiment of rotatable and extendable mop respectively, according to the present invention. The rotatable and extendable mop 100 comprises primarily a first rod body 10, a second rod body 20 and a mop head 30. Two ends of the second rod body 20 are connected respectively to the first rod body 10 and the mop head 30; whereas, another end of the mop head 30, opposite to the second rod body 20, is provided with plural yarns 31. The aforementioned rotatable and extendable mop 100 can be used in association with a mop cleaner 200, wherein the mop cleaner 200 is provided with a bucket 40, and an interior of the bucket 40 is provided with a dehydration sink 41. The bucket 40 provides for holding a cleaning solution to clean the mop head 30 and yarns 31 (such as clean water or cleaning solution added by a detergent). Preferably, the rotatable and extendable mop 100 is operated by pressing down manually. After the mop head 30 has been put into the dehydration sink 41, the user can hold the first rod body 10 by hands and execute a press-down action, so that the yarns 31 and the dehydration sink 41 can rotate simultaneously, thereby achieving the object of dehydrating and squeezing dry the mop under the function of centrifugal force.

Figure 5:
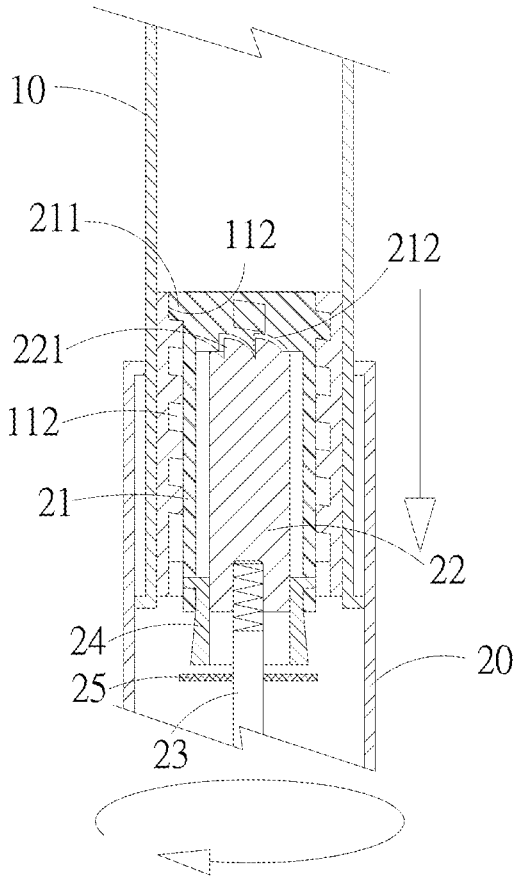
FIG. 5 shows a fifth schematic view of the first embodiment of rotatable and extendable mop, according to the present invention.

Next, please refer to FIGS. 3 to 6, showing respectively a third schematic view, a fourth schematic view, a fifth schematic view and a sixth schematic view of the first embodiment of rotatable and extendable mop, according to the present invention. These schematic views are to describe the detailed structures of each part of the rotatable and extendable mop 100. An interior at one end of the first rod body 10 is compressed and fixed with a fixing seat 11 which is formed with a first shaft hole 111. A wall of the first shaft hole 111 is provided with at least one first helical track 112. In the first embodiment, the first helical track 112 is concaved into, but not limited to, the wall of the first shaft hole 111. An end of the second rod body 20 is sheathed with the first rod body 10 and can extend and move relatively with respect to the first rod body 10. The second rod body 20 includes a first connector 21 and a second connector 22. The first connector 21 is sheathed with the second connector 22, and a first mono-directional spin axis connection piece 212 and a second mono-directional spin axis connection piece 221 are disposed between the first connector 21 and the second connector 22. The first mono-directional spin axis connection 212 and the second mono-directional spin axis connection piece 221 are provided respectively with plural ratchets 2121, 2211 that can be combined together. In the first embodiment, the first connector 21 is provided with four first clip parts 211 corresponding to the aforementioned first helical track 112. Each first clip part 211 is formed as a block and is protruded out of the first connector 21, so that the first clip part 211 can traverse in the first helical track 112. On the other hand, the first helical track 112 is in a spiral shape, allowing the first connector 21 and the second connector 22 to rotate. In addition, by the function of the first mono-directional spin axis connection piece 212 and the second mono-directional spin axis connection piece 221, when the second rod body 20 approaches the first rod body 10, the second rod body 20 will rotate (as shown in FIG. 5); whereas, when the second rod body 20 moves away from the first rod body 10, the second rod body 20 will not rotate.

Furthermore, the second rod body 20 also includes a link rod 23, a retainer 24, a gasket 25, a spring 26 and an adapter 27. An end of the link rod 23 is connected to the second connector 22 and the other end of the link rod 23 is connected to the adapter 27. To be more specific, the link rod 23 can be a polygonal cylinder, with two ends being inserted respectively into a circular or polygonal connecting hole 271 (not shown in the drawings) of the second connector 22 and the adapter 27. Through the different structure of the link rod 23 from the connecting hole 271 or the diagonal matching between the two, the probability of loosening to the combination of the link rod 23 with the second connector 22 and the adapter 27 can be decreased. The retainer 24, gasket 25 and spring 26 are sheathed orderly with the link rod 23 from near to far relative to the second connector 22, meaning that the retainer 24 is the closest to the second connector 22, the spring 26 is more distant from the second connector 22, and the gasket 25 is disposed between the retainer 24 and the spring 26. After assembling, the retainer 24 is fastened to a retaining hole 213 of the first connector 21, and through the locking between the retainer 24 and the retaining hole 213, the fixity of connection between the first connector 21 and the second connector 22 can be increased. Another end of the adapter 27, opposite to the link rod 23, is used for combining with the mop head 30.

Figure 6:
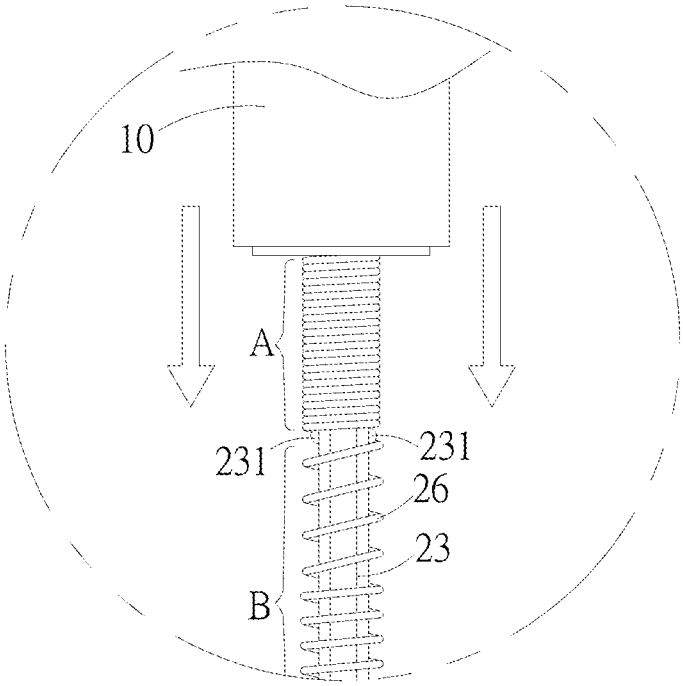
FIG. 6 shows a sixth schematic view of the first embodiment of rotatable and extendable mop, according to the present invention.
Figure 7:
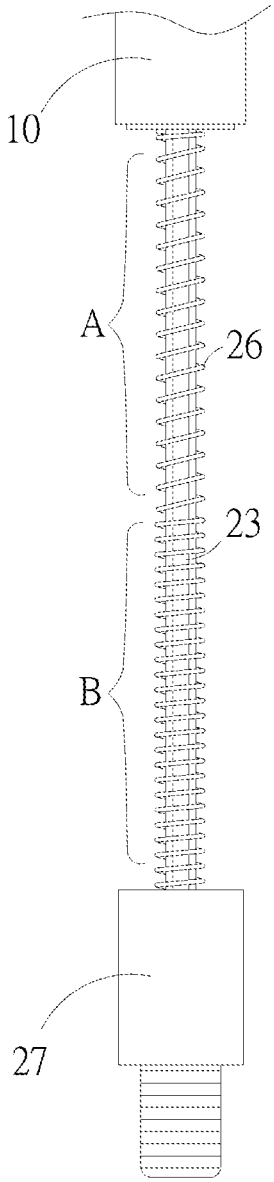
FIG. 7 shows a schematic view of a mode of spring of the rotatable and extendable mop, according to the present invention.
Figure 8:
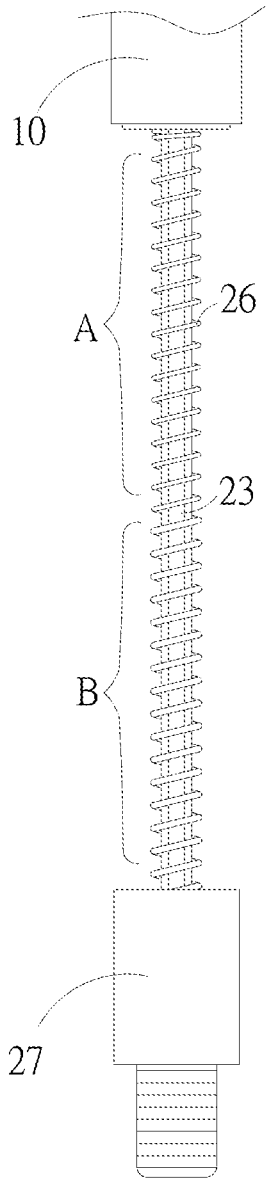
FIG. 8 shows a schematic view of another mode of spring of the rotatable and extendable mop, according to the present invention.

Moreover, it is especially noteworthy that the spring 26 disclosed by the present invention is designed to have plural elastic sections. In the first embodiment, the spring 26 is divided into an elastic section A and an elastic section B, wherein plural buffering bumps 231 of an inner diameter a little larger than that of the coils of spring 26 are disposed on the link rod 23 corresponding to a position between the elastic section A and the elastic section B, so that the elastic sections A, B can be compressed sectionally from top to bottom, as shown in FIG. 6. For example, when the user exerts a force to press down the mop, the spring 26 will start to compress. At this time, the elastic section A of the spring 26 will be compressed first completely by the separation and abutting of the buffering bumps 231. When the user exerts a larger force to press down the mop, the elastic section B will begin to compress until being compressed completely. Therefore, the compression force will be reduced sectionally, thereby extending the lifetime of usage of the mop. It is noteworthy that each elastic section A, B of the spring 26 can be further designed to have a different modulus of elasticity. For example, the coil spacing of the elastic section A of the spring 26 can be set at 5 mm, whereas the coil spacing of the elastic section B is set to 3 mm, which allows the coil spacing of the elastic sections A, B to be different, thereby forming plural elastic sections in different modulus of elasticity, as shown in FIG. 7. On the other hand, the elastic section A and the elastic section B of the spring 26 can be designed at a different radius, forming two elastic sections A, B in different modulus of elasticity, as shown in FIG. 8. Dividing the spring into the sections in different modulus of elasticity can extend the lifetime of usage, and is able to provide the user with a better and progressive touch when using the mop.

Figure 9:
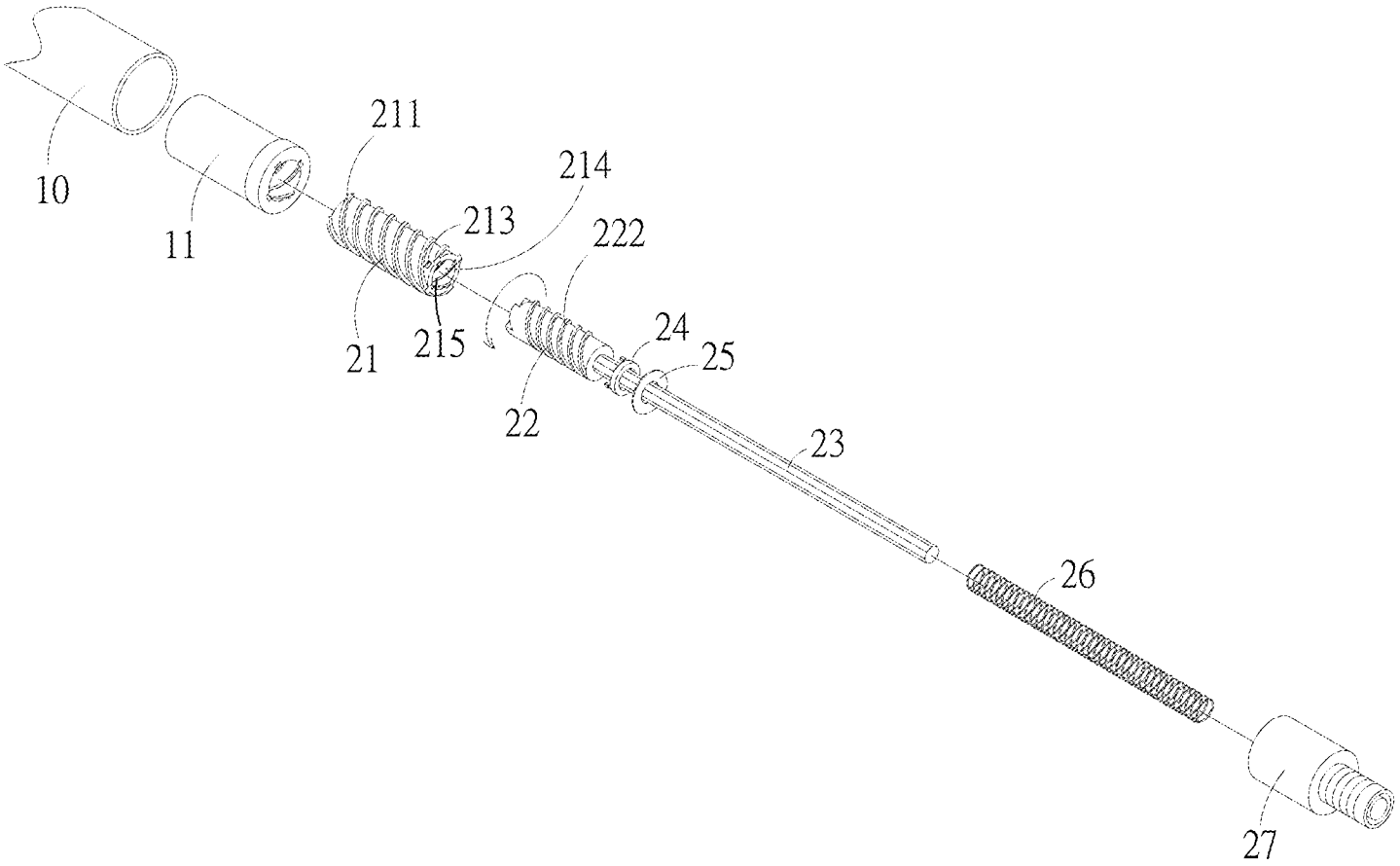
FIG. 9 shows a schematic view of a second embodiment of rotatable and extendable mop, according to the present invention.

In addition, referring to FIG. 9, it shows a schematic view of a second embodiment of rotatable and extendable mop, according to the present invention. For the second embodiment of rotatable and extendable mop, the first clip part 211 of the first connector 21 is designed as a spiral structure corresponding to the first helical track 112 and protruding out of the first connector 21. Furthermore, the first connector 21 is provided with a second shaft hole 214, a wall of the second shaft hole 214 is provided with at least one second helical track 215 (not shown in the drawing), and the second connector 22 is provided with a second clip part 222 corresponding to the second helical track 215 that the second clip part 222 can traverse in the second helical track 215. In the second embodiment, the second track 215 is concaved into the wall of the second shaft hole 214, and the second clip part 222 is a spiral structure protruding out of the second connector 22. Through the provision of the second helical track 215 and the second clip part 222, the connection and rotation between the first connector 21 and the second connector 22 can be stabilized.

It is to be understood that the above description and drawings are only used for illustrating some embodiments of the present invention, not intended to limit the scope thereof. Any variation and deviation from the above description and drawings should be included in the scope of the present invention.

What is claimed is:

1. A rotatable and extendable mop comprising:

a first rod body, an end of the first rod body being formed with a first shaft hole, and a wall of the first shaft hole being provided with at least one first helical track;

a second rod body, an end of the second rod body being sheathed with the first rod body to move and extend relatively with respect to the first rod body, the second rod body including a first connector, a second connector, a retainer, a gasket, a spring and a link rod, the first connector being sheathed with the second connector, allowing a first mono-directional spin axis connection piece of the first connector to be abutted with a second mono-directional spin axis connection piece of the second connector, the first connector being provided with a first clip part corresponding to the first helical track, allowing the first clip part to traverse in the first helical track, an end of the link rod being connected to the second connector, the retainer, the gasket and the spring being sheathed with the link rod orderly from near to far relative to the second connector, and the retainer being fastened to a retaining hole of the first connector; and a mop head, an end of the mop head being connected to the other end of the second rod body, and the other end of the mop head being provided with plural yarns.

2. The rotatable and extendable mop according to claim 1, wherein the second rod body further includes an adapter, with an end of the adapter being connected to the link rod, and the other end being used for combining with the mop head.

3. The rotatable and extendable mop according to claim 2, wherein the link rod is a polygonal cylinder, with two ends of the link rod being inserted respectively into a connecting hole of the second connector and the adapter.

4. The rotatable and extendable mop according to claim 1, wherein the spring includes plural elastic sections, with a coil spacing or radius of each elastic section being different, allowing each elastic section to have a different modulus of elasticity.

5. The rotatable and extendable mop according to claim 4, wherein a buffering bump is disposed on the link rod corresponding to a position between the elastic sections, allowing the plural elastic sections of the spring to be compressed from top to bottom sectionally.

6. The rotatable and extendable mop according to claim 1, wherein the first connector is provided with a second shaft hole, a wall of the second shaft hole is provided with at least one second helical track, and the second connector is provided with a second clip part corresponding to the second helical track, allowing the second clip part to traverse in the second helical track.

7. The rotatable and extendable mop according to claim 6, wherein the second helical track is concaved into the wall of the second shaft hole, and the second clip part is a spiral structure protruding out of the second connector.

8. The rotatable and extendable mop according to claim 1, wherein the first mono-directional spin axis connection piece and the second mono-directional spin axis connection piece are provided with plural ratchets that are combined together.

9. The rotatable and extendable mop according to claim 1, wherein an interior of the first rod body is compressed and fixed with a fixing seat, and the first shaft hole and the first helical track are disposed on the fixing seat.

10. The rotatable and extendable mop according to claim 1, with the mop being used in association with a mop cleaner, the mop cleaner being provided with a bucket, and an interior of the bucket being provided with a dehydration sink.

11. The rotatable and extendable mop according to claim 1, wherein the first helical track is concaved into the wall of the first shaft hole, and the first clip part is a block structure or spiral structure protruding out of the first connector.

12. A rotatable and extendable mop comprising:

a first rod body, an end of the first rod body being formed with a first shaft hole, and a wall of the first shaft hole being provided with at least one first helical track;

a second rod body, an end of the second rod body being sheathed with the first rod body to move and extend relatively with respect to the first rod body, the second rod body including a first connector, a second connector, a retainer, a gasket, a spring, a link rod and an adapter, the first connector being provided with a first clip part corresponding to the first helical track, allowing the first clip part to traverse in the first helical track, the second connector being sheathed with the first connector, the first connector being provided with a second shaft hole, a wall of the second shaft hole being provided with at least one second helical track, the second connector being provided with a second clip part corresponding to the second helical track, allowing the second clip part to traverse in the second helical track and a first mono-directional spin axis connection piece of the first connector to be abutted with a second mono-directional spin axis connection piece of the second connector, two ends of the link rod in a shape of polygonal cylinder being connected respectively to a connecting hole of the second connector and the adapter, the retainer, the gasket and the spring being sheathed with the link rod orderly from near to far relative to the second connector, the retainer being fastened to a retaining hole of the first connector, the spring including plural elastic sections in different coil spacing, a bumping buffer being disposed on the link rod corresponding to a position between the elastic sections, allowing the plural elastic sections of the spring to be compressed from top to bottom sectionally; and a mop head, the mop head being disposed at the other end of the second rod body, an end of the mop head being connected to the adapter, and the other end of the mop head being provided with plural yarns.

* * * * *